United States Patent [19]

Moore

[11] 4,117,988

[45] Oct. 3, 1978

[54] REEL ADAPTER FOR TIE MATERIAL AND METHOD OF USING THE SAME

[75] Inventor: Doyle A. Moore, R.R. 2, P.O. Box 207, Worthington, Minn. 56187

[73] Assignee: Bedford Industries, Inc., Worthington, Minn.

[21] Appl. No.: 678,923

[22] Filed: Apr. 21, 1976

[51] Int. Cl.[2] ..... B63H 75/18

[52] U.S. Cl. ..... 242/71.9; 242/71.8

[58] Field of Search ..... 242/71.8, 71.9, 73, 242/115, 116, 118.4, 118.5

[56] References Cited

U.S. PATENT DOCUMENTS

| | | | |
|---|---|---|---|
| 2,127,772 | 8/1938 | Horn | 242/71.9 |
| 2,518,533 | 8/1950 | Edwards | 242/71.8 |
| 3,017,132 | 1/1962 | Gnage | 242/71.9 |

*Primary Examiner*—Edward J. McCarthy

[57] ABSTRACT

An adapter is provided consisting of a tubular center section and a pair of circular flange sections at each end of the tubular center section. One of the flanges is removable so that coils of tie material such as string, cord, wire, or plastic or paper covered wire and the like can be placed on the adapter and the flange replaced. The tube is segmented circumferentially and can be expanded to tightly engage the inside surface of the coil. One of the flanges floats axially on the adapter and is resiliently biased in the direction of the other flange to tightly engage the side surfaces of the wound up coil.

9 Claims, 4 Drawing Figures

REEL ADAPTER FOR TIE MATERIAL AND METHOD OF USING THE SAME

FIELD OF THE INVENTION

The invention relates to a method and means for holding coils of elongated tie material and more particularly to a reel adapter of the type which can be partially disassembled for replacing or removing coils or reels of wound material thereupon.

THE PRIOR ART

In recent years tie ribbon, much of which is manufactured from wire embedded in plastic, has been used on an ever increasing scale for tying packages such as bread bags. Previously, tie material or ribbon of this kind was stored on unitary spools which consist of a tube having two circular flanges, one connected permanently to each end of the tube. These spools in addition to being expensive produce a handling problem and the accumulation of large numbers of used spools produces a disposal problem. The reels previously used required the end flanges to hold the coils of tie material securely and prevent them from becoming unraveled or collapsing. Now it has been found possible to use a tubular spool with no end flanges or in some cases an entirely spoolless coil of tie ribbon by twisting the ribbon periodically during the winding operation to make a more secure coil and to render the coil stable. Thus, by twisting the tie ribbon at each edge of the coil or cylinder of wound material it can be rendered relatively stable as will be understood by those skilled in the art. This system of winding which has been used in the textile industry can be thought of as a twist winding system. However, even though quite stable, the wound coils or cylinders of tie material can still become misshaped or unravel when unwound. Moreover, when unwound, the coil of material must be held with a constant frictional drag to resist the unwinding force applied by the tension on the length of material being unwound. Thus a problem found in the development of the present invention is that spools must be securely engaged to provide the proper frictional drag. However, the engagement of the adapter with the inside surface of the coil can interfere with the engagement or retention of the flat side surfaces of the coil as required to prevent the coil from falling apart or collapsing.

Thus, one phase of the present invention concerns the provision of an expandable means for engaging the inside cylindrical surface of the coil but because of the slight variations in the thickness of the coil from one flat surface to the other, the tightening of the adapter for the purpose of frictionally engaging the inside surface of the coil could also press the end flanges too tightly against the wound coil preventing interior engagement. Therefore, there is a need to securely and firmly hold the flat end flanges against the flat corresponding surfaces of the wound coil of material to prevent the coil from falling apart or becoming unraveled while at the same time firmly engaging the inside cylindrical surface of the coil so that it will not be free to rotate on the adapter and the adapter can consequently be utilized to apply a controlled frictional drag as material is unwound.

OBJECTS

The major objects are to provide an adapter in the nature of a spool which (a) can be disassembled i.e., can be separated into parts for the mounting or removal of coils of wound material, (b) includes a means for engaging a coil of wound tie material on each of its flat end surfaces, (c) is capable of being used for supporting coils of wound tie material which are both spoolless or contain an interior tubular spool without ends, (d) includes a provision for firmly engaging the flat ends of the wound coil and applying a predetermined pressure to the flat ends of the coil to prevent the coil from collapsing or some winds on the coil from slipping off the end, (e) a provision for engaging the central portion of the adapter to the inside cylindrical surface of the coil to prevent the coil from turning on the adapter, (f) the provision of an expandable collet of cylindrical shape for engaging the inside surface of the coil of wound material when expanded to retain the coil in place on the adapter and prevent it from rotating with respect to the adapter, (g) a provision for tightening the collet when the flange used for engaging one surface of the coil is moved toward the other flange and a further provision for allowing the flanges at the ends of the adapter to remain a fixed distance apart, one floating as the collet is expanded to engage the inside surface of the coil to thereby accomodate coils of different widths.

THE FIGURES

SUMMARY OF THE INVENION

The invention provides a reel adapter and method for supporting and engaging a reel or coil of tie material such as a cord or wire tie ribbon. The adapter comprises a tubular body member and a pair of flat parallel axially spaced flanges extending normal to the tube. A fastening means is provided to removably secure one of the flanges to the tube so that the coil of tie material can be placed on the adapter and the flange replaced and secured in position on the tubular body. It is not critical where the separation is made between the tube and the flange. In one preferred form of the invention, for example, the flange separates from the tubular body section of the adapter at the end of the tube adjacent the center of the flange. It is, however, possible to have a portion of the tube connected to the flange so that when the flange is removed that portion of the tube is also removed. In other words, the point of removal of the flange need not be located exactly at the junction between the flange and the tubular body section.

In a preferred form of the invention, the tube includes a means for engaging the coil to prevent the coil from turning on the tube. This is preferably accomplished by forming the tube in sections which are capable of being moved outwardly against the inside surface of the coil or spool in case one is used. One preferred form of tube includes a plurality of circumferentially spaced longitudinally extending slots which divide the tube up into segments that are free at one end. In this form of the invention, the tube can be thought of as an expandable collet the free ends of which are engagable with a corresponding mating surface of a collet expander that is associated with a removable flange. The removable flange is capable of moving along the axis of the tube and when so moved in the direction of the opposite flange, the collet expander will engage the free ends of the tube segments thereby spreading them outwardly into contact with the coil or spool.

Also in a preferred form of the invention at least one of the flanges is floating and is resiliently urged in the direction of the other flange to thereby tightly press against the flat side surfaces of the coil when the adapter is assembled.

DESCRIPTION OF THE PREFERRED EMBODIMENT

Figure 3:
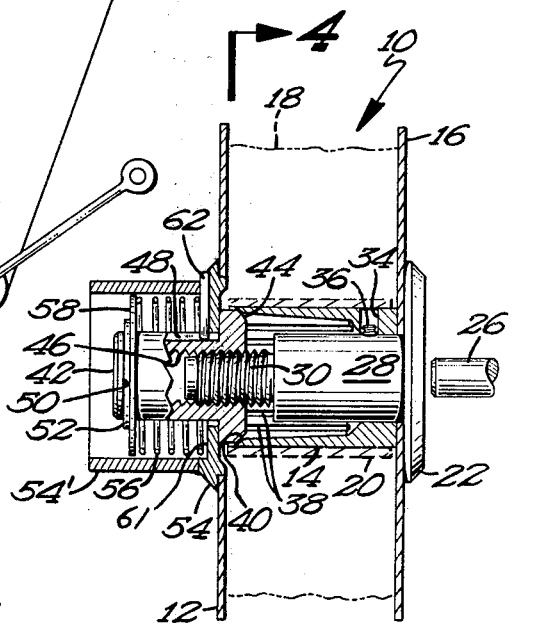
FIG. 3 is a vertical transverse sectional view taken on line 3—3 of FIG. 2.
Figure 4:
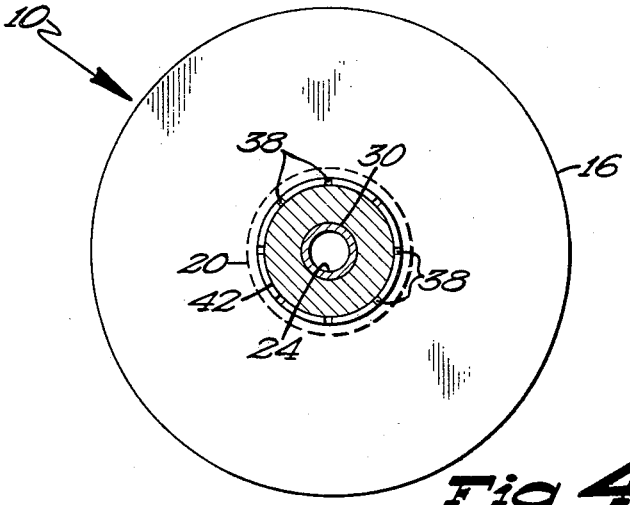
FIG. 4 is a vertical sectional view taken on line 4—4 of FIG. 3.

As shown in the Figures, an adapter in accordance with the invention is designated generally by the numeral 10. The adapter is composed of three major functional components comprising a left hand removable flange 12, a centrally located tubular body portion 14 and a right hand fixed flange 16. During use, as seen in FIG. 3 a coil of tie material such as plastic coated tie ribbon 18 is mounted upon the adapter with the left hand flange 12 abutting against one surface of the coil and the right hand flange 16 in contact with the other surface. The coil 18 is in this instance shown wound upon a rigid spool or core 20 which provides a certain amount of support before the coil 18 is put in place on the adapter. It will be seen that the inside surface of the core 20 is in contact with the outer surface of the tubular body 14.

Figure 2:
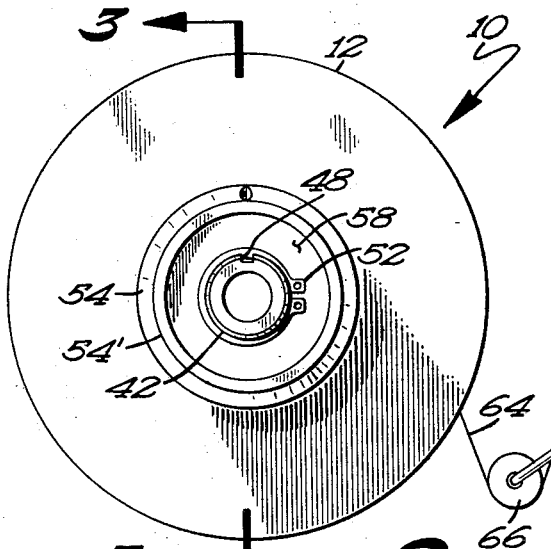
FIG. 2 is an end elevational view of the adapter when assembled as seen from the left end of FIG. 1.

The flanges 12 and 16 are both circular as seen in FIGS. 2 and 3. Flange 16 is rigidly secured as by welding to a flange hub 22 which is provided with a central bore 24 adapted to slide readily onto a shaft 26 of supporting machinery such as a tying machine of any known construction. The shaft 26 will normally be either rotated by a motor (not shown) or allowed to rotate with a certain predetermined degree of frictional resistance so that as the tie material of the coil 18 is unwound, the shaft 26 acting through the adapter 10 will exert a predetermined degree of resistance to the unwinding force exerted on the tie material.

The flange hub includes a threaded tube section 28 which is threaded at 30 adjacent its free end, the end furthest from the flange 16.

Figure 1:
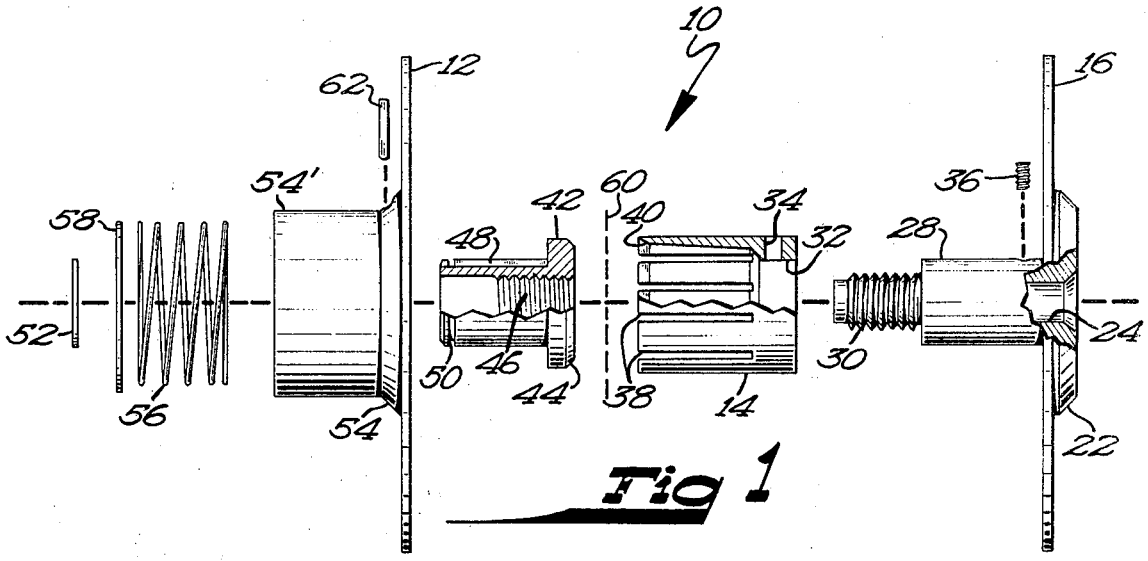
FIG. 1 is an exploded side elevational view of an adapter embodying the invention.

As seen in FIGS. 1 and 3, the tubular body section is provided with a bore 32 of just the appropriate size to slide easily onto the threaded tube 28. It also includes a transverse bore 34 through which a set screw 36 extends to hold the tubular body on the tubular portion 28 of the hub 22. The set screw 36 extends all the way to the central bore 24 and when tightened will lock the tube 28 and the entire adapter 10 to the shaft 26. The tubular body section 14 is provided with a plurality of longitudinally extending circumferentially spaced slots 38 that divide it into longitudinally extending segments which by virtue of the resiliency of the material from which the tube is made are able to expand outwardly at times as will be described below. The free ends of the segments of the tubular body 14 between slots 38 are internally beveled at 40 with the bevel preceding centrally, i.e. toward the axis of the tube in the direction of the fixed ends of the tube segments separated by the slot 38. These segments can thus be moved at times outwardly against the inner surface of the coil making the tube 14 expandable. The tube 14 can thus be thought of as an expandable collet.

Mounted just to the left of the tube 14 is a collet expander 42 having a conical expander surface 44 on its right end concentric with the center thereof and of the proper diameter and angular orientation to mate with the conical surface 40 of the tube 14 so as to expand the segments of the tube between slots 38 outwardly as the expander 42 is moved toward the right in the Figures. The expander is provided with a central longitudinally extending threaded bore 46 which is threaded upon the screw threads 30 when the adapter is assembled. The expander includes longitudinally extending exterior slot 48 and a circumferentially extending slot 50 for a spring clip 52.

The circular flange 12 at the left is rigidly secured as by welding to a flange hub 54 having a tubular axially extending spring cover 54'. Inside the cover 54' is a helical compression spring 56 which abuts at its left end as shown in FIG. 3 against a washer 58 that is held in place on the collet expander by the spring clip 52 and presses at its right end against the inside surface 61 of the hub 54. As seen best in FIG. 3, a pin 62 is mounted in a radially extending bore of the flange hub so that its inner end is slidably engaged within the slot 48 to prevent the spring cover 54' and flange 12 from turning on the collet expander 42 so that the spring cover 54' can be used as a handle in assembling and disassembling the adapter.

The manner in which the invention is used will now be described. To assemble the adapter, the tubular body 14 is slid onto the threaded tube 28 after removing set screw 36. The set screw is then replaced through bore 34 and the right hand or fixed flange 16 and tube 14 now held in place by set screw 36 is placed on the shaft 26. The set screw 36 is then tightened against shaft 26 to secure the adapter in place on the shaft.

The left hand or removable portion of the adapter is assembled by the manufacturer by sliding the collet expander 42 into the flange hub 54, introducing spring 56 into the cover 54' and assembling the washer 58 and spring clip 52 on the expander 42. The pin 62 is then inserted far enough so that its inner end extends into slot 48. Thus, all of the parts to the right of line 60 in FIG. 1 will normally be assembled and handled as a single component. Likewise, the parts to the left of line 60 will be assembled and will normally remain assembled and handled as a single unit. When a coil 18 is to be placed on the adapter, the cover 54' is grasped manually and the hub 54 and flange 12 are turned about the central axis of the adapter thereby unscrewing the expander 42 from the screw threads 30 of the threaded tube 28 allowing the flange 12, the hub 54 and the expander 42 to be removed. The coil 18 either with or without the core 20 is then placed on tube 14 so that its right hand surface abuts against the inner surface of the flange 16. The removable flange and its associated parts are then replaced on the threads 30 and the cover 54' is turned manually in a clockwise direction so as to tighten the collet expander on the threads until the conical spreading surface 44 engages the mating conical surface 40 of the collet 14 which then expands thereby forcing the segments of the tube 14 between the slots 38 outwardly into firm frictional engagement with the inner surface of the coil 18 or core 20 as the cast may be. As the unit is being assembled in this manner, the inner surface of the flange 12 will engage the mating flat side surface of the coil 18 and as the expander 42 continues to turn on threads 30, the engagement between the coil 18 and the flange 12 will force the flange 12 and the hub 54 back i.e., toward the left against the spring 56 which thus functions to resiliently urge the flange and hub against the coil 18. In this way, the flange 12 can be though of as a floating flange with resilient means for yieldably biasing it against the coil 18.

Thus, the invention provides a means for tightly engaging the adapter with the inside cylindrical surface of the coil as well as the flat side surfaces of the coil and will accomodate coils of different widths i.e., different distances between the flanges 12 and 16 since flange 12 floats on the adapter. Moreover, the spring 56 serves to provide a predetermined biasing force yieldably retaining the flanges in contact with the sides of the coil 18 regardless of its width. In addition, in spite of such variations in the size of the coils, the collet expander 42 will reliably engage and expand the free ends of the tube segments as required to hold the tube in engagement with the coil.

When the adapter is in use as shown in FIG. 2, the tie material 64 is withdrawn and fed over suitable guides such as wheels 66 and 68 upon which it travels to downstream equipment such as bread bag tying machines or the like. The adapter can be used with a variety of tie materials. The term "tie material" as used herein is meant to indicate any elongated flexible or non-flexible tying material such as wire embedded in strips of paper or plastic as well as cord, twine, etc.

What is claimed is:

1. A reel adapter for supporting a coil of tie material, said adapter comprising a tubular body member generally in the form of a cylinder, a flange member located at each end of the tubular body member, the flange members being parallel and oriented normal to the axis of the tube, fastening means for removably securing at least one of the flanges on the tube so that the coil of tie material can be placed on the adapter and the removable flange replaced and said adapter having means thereon for engaging the wound coil of tie material to the adapter to prevent rotation of the tie material on the adapter, said tube comprising an expandable collet having a plurality of longitudinally extending circumferentially spaced segments with notches between them, the segments being free at one end and integrally connected at the other end and a collet expanding means operatively associated with the free ends of the segments to press the segments outward when the removable flange is moved in the direction of the other flange and the adapter includes a means for retaining the removable flange and collet expanding means thereupon.

2. The apparatus of claim 1 wherein the means for retaining the collet expander upon the adapter comprises an axially extending screw thread connection between the removable flange and the adapter whereby the removable flange and the collet expander can be unscrewed and removed from the adapter and replaced by being turned on the screw threads in the appropriate direction to move the flange and collet expander axially of the tube in the direction of the other flange until the collet expander contacts the free ends of the tube segments forcing them into contact with the inside surface of the coil to thereby securely retain the coil in place on the adapter.

3. The apparatus of claim 1 wherein a collet expander is mounted concentrically within the removable flange, said collet expander includes a conical section at the end thereof closest to the tubular body, the free ends of the segments of the tube include a conical surface and the conical surface of the collet expander is of the appropriate size and angular orientation to mate with the conical surface at the ends of the tube segments, the collet expander having an axial bore with screw threads therein and the other flange having a hub with a central axially extending screw threaded tubular member screw threaded into the threaded bore of the collet expander.

4. The apparatus of claim 3 wherein the removable flange includes an axially extending spring cover, a spring mounted within the spring cover and operatively associated between the collet expander and the flange to yieldably bias the flange in the direction of the other flange and to yieldably bias the collet expander away from the other flange.

5. The apparatus of claim 4 wherein operative connection means is provided between the removable flange and the collet expander to allow the flange to slide axially of the collet expander but preventing rotation of the flange with respect to the collet expander whereby the collet expander can be screw threaded onto the adapter by manually grasping the spring cover.

6. A reel adapter for supporting a coil of tie material, said adapter comprising a tubular body member generally in the form of a cyliner, a flange member located at each end of the tubular body member, the flange members being parallel and oriented normal to the axis of the tube, fastening means for removably securing at least one of the flanges on the tube so that the coil of tie material can be placed on the adapter and the removable flange replaced and said adapter having means thereon for engaging the wound coil of tie material to the adapter to prevent rotation of the tie material on the adapter, one of said flanges is axially slidable on the adapter and resilient means is provided for yieldably biasing said one flange in the direction of the other flange.

7. The apparatus of claim 6 wherein the fastening means for said one flange is a screw thread connector operatively associated between the removable flange and the other flange.

8. A reel adapter for supporting a coil of tie material, said adapter comprising a tubular body member generally in the form of a cylinder, a flange member located at each end of the tubular body member, the flange members being parallel and oriented normal to the axis of the tube, fastening means for removably securing at least one of the flanges on the tube so that the coil of tie material can be placed on the adapter and the removable flange replaced and said adapter having means thereon for engaging the wound coil of tie material to the adapter to prevent rotation of the tie material on the adapter, one of said flanges is fixed upon the adapter and the other flange is able to float axially of the tube and resilient means is operatively associated with the floating flange to yieldably bias the floating flange upon the adapter in the direction of the other flange.

9. A method of supporting and controlling unwinding of a coil of tie material from a reel adapter having a tube portion engagable with the coil to prevent rotation of the coil thereupon and a pair of flanges one of which flanges is removable, said method comprising, (a) placing the coil on said tube such that one side surface of said coil abutts against the inner surface of one flange, (b) placing the removable flange on the adapter, (c) engaging the tube portion with the coil so as to prevent rotation of the coil thereupon, (d) forcing the inner surface of said removable flange against the opposite side surface of the coil, (e) yieldably biasing at least one flange into engagement with the coil while the coil is on the adapter, and (f) thereafter unwinding the tie material from the coil while the tube is thus engaged with the coil and one of the flanges is yieldably biased against the coil.

* * * * *